United States Patent [19]

Beck

[11] Patent Number: 4,498,267

[45] Date of Patent: Feb. 12, 1985

[54] SIMULATED CLAY TILE ROOF CONSTRUCTION AND METHOD OF MAKING SAME

[76] Inventor: Ermon Beck, 55820 River Shore Estates, Elkhart, Ind. 46516

[21] Appl. No.: 445,060

[22] Filed: Nov. 29, 1982

[51] Int. Cl.[3] ..... E04D 1/00; E04D 1/08

[52] U.S. Cl. ..... 52/555; 52/57; 52/309.1; 52/314

[58] Field of Search ..... 52/555, 518, 57, 314, 52/309.1

[56] References Cited

U.S. PATENT DOCUMENTS

| | | | |
|---|---|---|---|
| 3,485,002 | 12/1969 | Baker | 52/555 X |
| 3,830,687 | 8/1974 | Re et al. | 52/555 X |
| 4,226,070 | 10/1980 | Aragon | 52/314 X |
| 4,251,967 | 2/1981 | Hoofe | 52/555 X |
| 4,322,924 | 4/1982 | Cooper | 52/57 |
| 4,372,090 | 2/1983 | Shichijo | 52/518 X |

FOREIGN PATENT DOCUMENTS

| | | | |
|---|---|---|---|
| 1255276 | 9/1967 | Fed. Rep. of Germany | 52/57 |
| 2612181 | 10/1976 | Fed. Rep. of Germany | 52/555 |

*Primary Examiner*—J. Karl Bell

[57] ABSTRACT

A simulated clay tile roof construction is provided which includes a plurality of roof panel members which are each formed to simulate the appearance of a plurality of clay roof tiles. To minimize the weight and ease the assembly of the roof panel members, they are provided with cut-out sections at diagonally opposite corners. To optimize the strength and minimize the weight and cost of the panel members, they are constructed by molding with an upward facing weather resistant gel-layer over the entire surface, with an underlayer of fiberglass reinforced gypsum over a majority of the surface thereover, and with a high strength underlayer of fiberglass reinforced plastic along the lateral edges thereof. A method of making the roof panel members is also proposed, including applying the fiberglass for the gypsum layer while the underlayer is still wet, applying the gypsum to the fiberglass layer, and then rolling the layers to mechanically bond the same together.

9 Claims, 12 Drawing Figures

SIMULATED CLAY TILE ROOF CONSTRUCTION AND METHOD OF MAKING SAME

BACKGROUND AND SUMMARY OF THE INVENTION

The present invention relates to a simulated clay tile roof construction. Due to the costs for materials, the weight, and the cost of construction using conventional clay tiles, there have been many simulated tile roof constructions proposed in the past. For example, see U.S. Pat. No. 779,883 to J. Singer for IMITATION TILING and U.S. Pat. No. 1,633,755 to J. Tyra for METAL SPANISH TILE. It has also been contemplated to use fiberglass and synthetic resinous material for the manufacture of roof tiles and other building components as exemplified by U.S. Pat. Nos. 3,830,687 to Re et al for FLAME RETARDANT AND FIRE RESISTANT ROOFING MATERIAL; No. 3,030,234 to J. L. McClinton for FILLED POLYESTER RESIN HAVING A COATING OF EPOXY RESIN AND METHOD OF MANUFACTURING THE SAME; No. 4,279,106 to Gleason et al for ROOFING PANEL; and No. 4,242,406 to El Bouhnini et al for FIBER REINFORCED COMPOSITE STRUCTURAL LAMINATE COMPOSED OF TWO LAYERS TIED TO ONE ANOTHER BY EMBEDDED FIBERS BRIDGING BOTH LAYERS.

The prior art simulated tile roof arrangements have not been satisfactory in all respects with regard to appearance, durability, weather resistance, weight, and costs for manufacture and costs for assembly into building roofs. For example, with mobile home arrangements, it is especially important that the simulated tile roof exhibits a minimum weight without compromising the appearance, the weather resistance, and the strength while at the same time being economical to manufacture and assemble in the finished building construction.

The present invention proposes a new simulated tile roof construction which overcomes the above mentioned disadvantages of prior arrangements and provides for an especially light weight, attractive, and inexpensive installation. The simulated tile roof panel members of preferred embodiments of the present invention are molded as unitary members with a plurality of layers of material, with an upper layer of gelcoat which is colorfast and weather resistant. In order to minimize the cost of construction, while optimizing the strength and weight of the roof panel members, a substantial portion of the area of the individual panel members is constructed of fiberglass reinforced gypsum, with only edge portions at raised simulated tile parts being of fiberglass reinforced plastic. In this way, the economics of the fiberglass reinforced gypsum construction are obtained, while the necessary strength at the edge of the panel member where it is joined to the next adjacent panel is assured by means of the fiberglass reinforced plastic. Gypsum's fire retardant properties assist in assuring that this construction further results in a fireproof panel member at minimum total cost.

The present invention further contemplates a new and advantageous method of manufacturing the roof panel members. According to this method, the fiberglass reinforced gypsum layer is formed by adding fiberglass to a wet underlayer of gelcoat (plastic) and fiberglass, and then adding gypsum to this added fiberglass, followed by rolling of the composite fiberglass gypsum layer, whereby the wet underlayer serves to assist in forming a mechanical bond with the fiberglass reinforced gypsum layer in a reliable and economical manner.

According to another advantageous feature of preferred embodiments of the present invention, diagonally opposite corners of edge portions of the panel members, which are over-lapped and/or under-lapped with respect to the next adjacent panel when assembled to form a roof, are provided with corner cut-out sections which engagingly abuttingly interlock with corresponding corner cut-out sections of diagonally adjacent panel members when placed in position on an assembled roof. With this arrangement, the assembly of the panel members in precise proper relationship relative to one another is assured with a minimum of skill being required.

With the roof construction of the simulated tile panel members of the present invention, no felt and/or plywood underlayment is required. The panel members are secured by screws which extend through raised simulated tile portions and are attached to furring strips arranged across the rafter members. In this way, a very light-weight roof construction results, which is easily assembled by unskilled workers, but which provides a long lasting roof requiring practically no maintenance, which does not leak, and which is completely fireproof. The weight of the roof construction using the present invention is approximately $2\frac{1}{2}$ pounds per square foot of roof area, as compared to a normal shingled roof which would weigh 3 pounds per square foot plus the weight of the plywood and felt underlayment.

These and further features, objects, and advantages of the present invention will be more readily understood when considered in light of the following description and illustrations of preferred embodiments of the present invention.

DETAILED DESCRIPTION OF THE DRAWINGS

Figure 1:
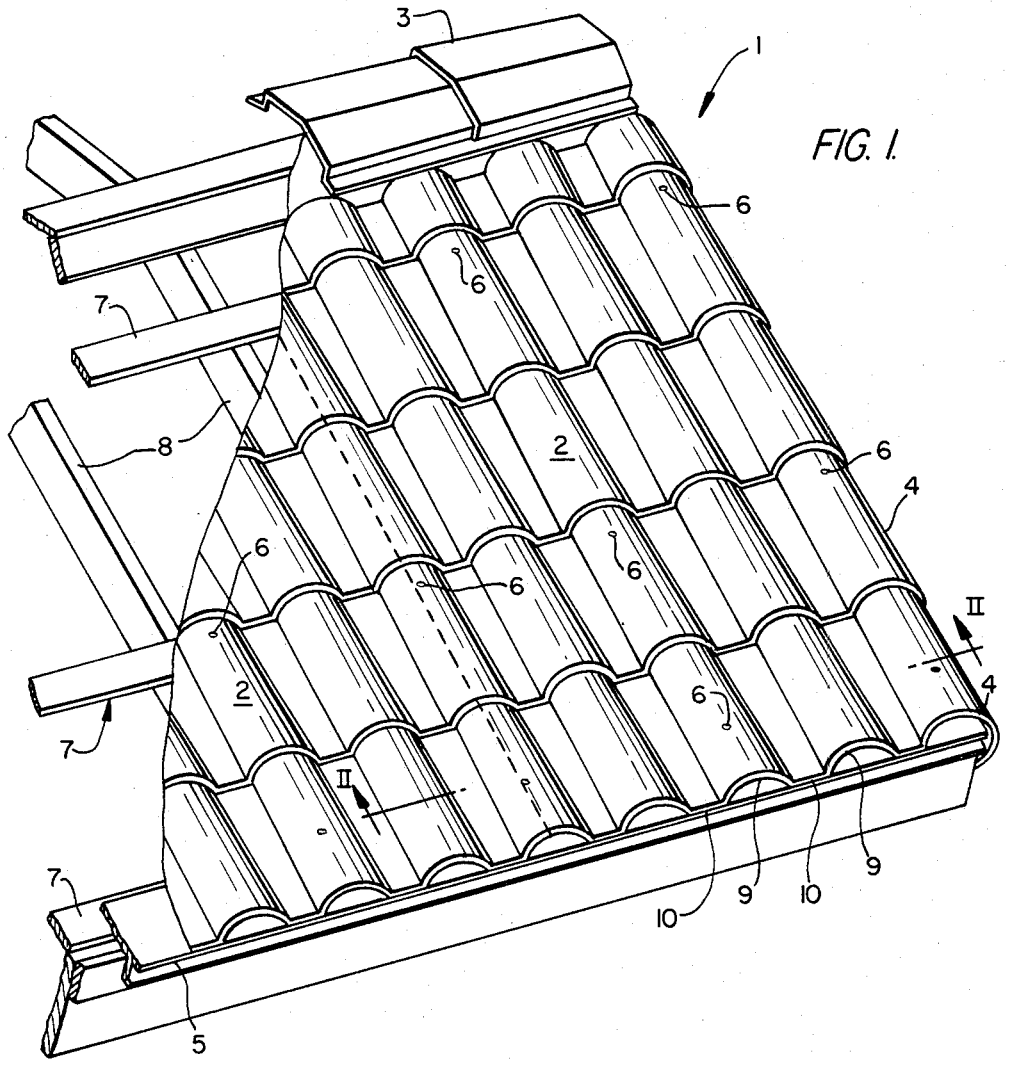
FIG. 1 is a partial perspective view of a roof construction in accordance with a preferred embodiment of the present invention.

Referring to FIG. 1, there is shown a roof construction which includes a plurality of roof panel members 2 joined together to form the major area of a roof, a ridge cap arrangement 3, endcap arrangement 4, and a roof flashing 5, all formed of synthetic tile simulated material. The simulated tile roof panel members are supported on the roof by means of screws 6 with furring strips 7 supported at rafter members 8.

Figure 2:
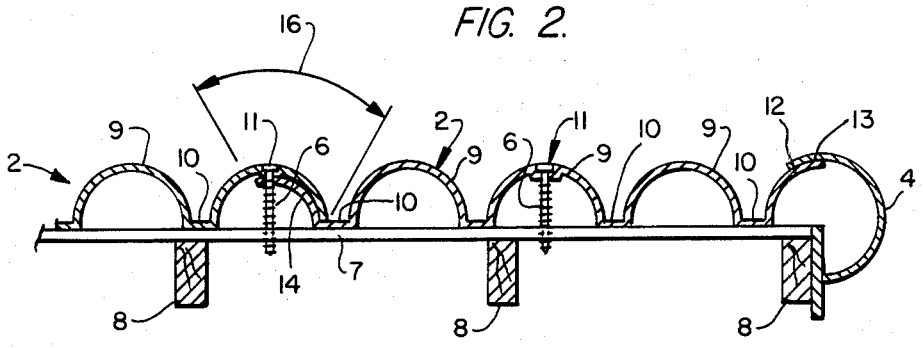
FIG. 2 is a sectional view along lines II—II of FIG. 1.

Referring to FIG. 2, each of the roof panel members 2 exhibits an upward appearance of part cylindrically shaped, raised tile member portions 9 separated by flat portions 10. The flat portions 10 lay directly on top of the furring strips and are held in place by the wood screws 6 extending through openings and pre-formed screwhead recesses 11. At the righthand edge of the panel member 2, which forms the edge of the roof construction, the raised portion 12 extends only semi-cylindrically and is overlapped by a fiberglass endcap 4, sealingly connected at 13 by adhesive sealing compound, such as that commercially available from Geocel Corporation and sold under their trademark GEOCEL.

At the left side of the panel member 2 as shown in FIG. 2, the last semi-cylindrical portion 14 is adapted to extend underneath an adjacent cylindrical part portion 15 of the laterally adjacent panel member. Approximately two-thirds of this end tile 15 (see part depicted by arrow 16) is constructed of fiberglass reinforced polyester, while the remaining portion of the panel members 2 are constructed of fiberglass reinforced gypsum. All of the exterior surfaces of the panel members 2 are coated with 18 mil gelcoat. The panel member 2 is formed by molding the layers together, such that they exhibit a thickness of approximately 3/16 inch thick gypsum and/or polyester covered by an 18 mil gelcoat.

The method of manufacturing the roof panel members includes the following steps in chronological order:

(i) constructing a female mold exhibiting a configuration corresponding to the upper surface of the roof panel member and placing this mold so that the upper surface of the roof panel member being formed faces downwardly, (ii) applying a gelcoat and fiberglass layer to the mold and rolling of same with a roller to form the gelcoat layer over the entire member, (iii) applying additional gelcoat and fiberglass layers to form the fiberglass reinforced plastic edge region 16, including rolling of same with a handroller, (iv) shielding the edge region and applying an additional layer of fiberglass over the remaining portions of the panel member while the underlayer formed by step (ii) is still wet so that the fiberglass adheres thereto, (v) applying gypsum to the fiberglass layer applied in step (iv) while said fiberglass layer is loosely held by the wet underlayer, and (vi) rolling the gypsum and fiberglass layer to form a mechanical bond with the wet underlayer, thus forming the fiberglass reinforced layer of the panel member and joining of same to the remaining gelcoat and fiberglass reinforced plastic parts of the panel member.

The rolling of the respective layers mentioned in the preceding paragraph is preferably done with a hand roller which serves to partially squeeze out the fluids and to compress the layers. For the fiberglass reinforced plastic four separate applications and rolling of each suffices for preferred embodiments of the method to form the edge region 16 with sufficient thickness and sufficiently close tolerance to accommodate overlapping connection with adjacent panel members. The layer of fiberglass reinforced gypsum is also rolled by hand rollers, the tolerance for same not being as rigid as for the edge regions since the surface formed by the hand rollers will be hidden from view, in the finished roof and is abuttingly carried at the wooden furring strip supports. Once the handrolling of the fiberglass reinforced gypsum layer is complete and the panel member is sufficiently dry, the panel member is simply pulled from the female mold and another panel member is formed. This process of manufacture is simple, reliable and economical, and assures the construction of similiar high quality panel members at a minimum of cost.

Adjacent roof panel members 2 are sealingly adhered to one another by means of a caulking or coating of polyurethene high density seal impregnated with a chemical sealant such as sold under the trademark WILL-SEAL.

Figure 3:
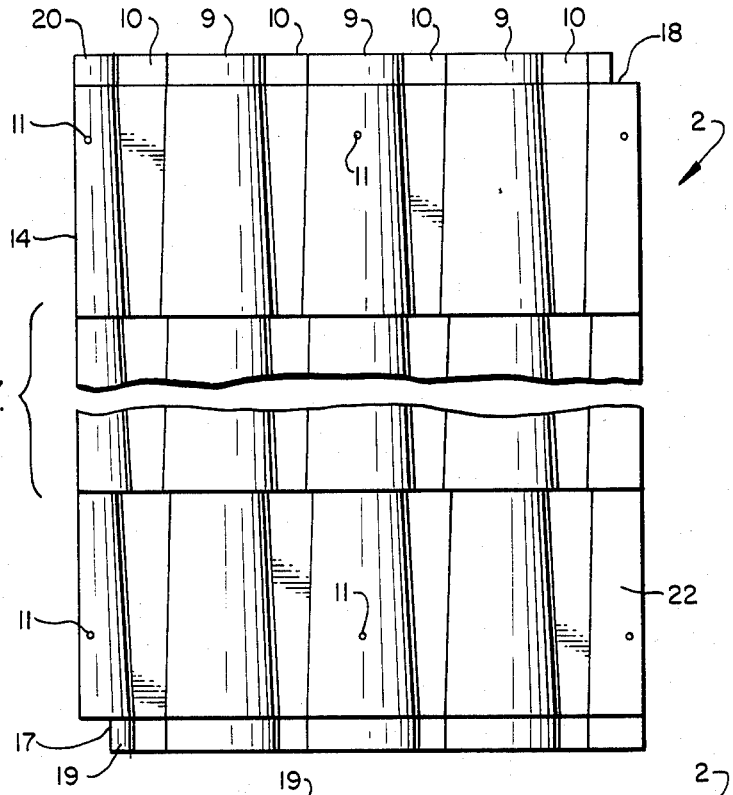
FIG. 3 is a top separated view of a single panel member constructed in accordance with a preferred embodiment of the present invention.
Figure 4:
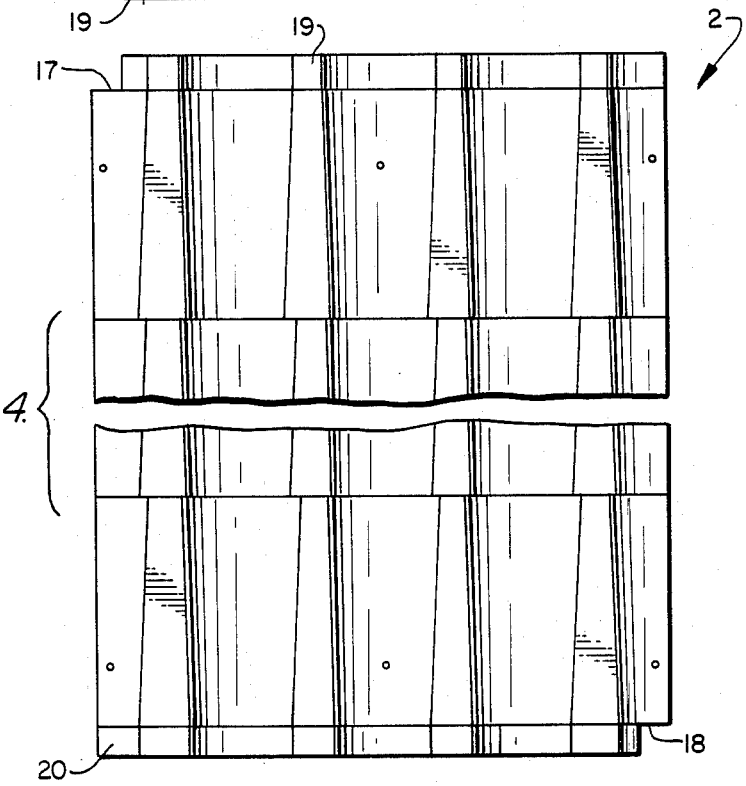
FIG. 4 is a separated bottom view of the panel member of FIG. 3.

As can best be seen in FIGS. 3 and 4, the panel members 2 include cut-out sections 17, 18 at respective diagonally opposite corners, which cut-out sections are disposed at edge portions 19 and 20, which are formed so as to accommodate overlapping connection with a correspondingly shaped adjacent panel member in a manner more specifically described below with reference to illustrations of FIGS. 5–9.

Figure 5:
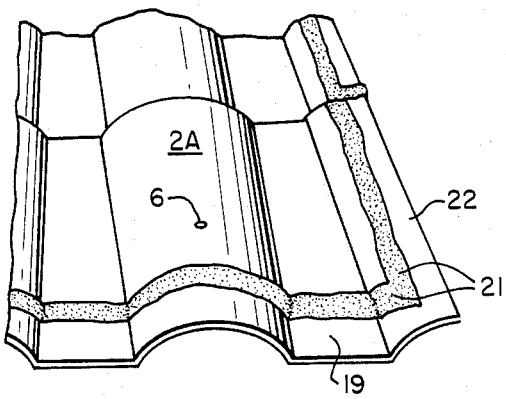
FIG. 5 is a perspective, part cut-away view illustrating a corner of a first panel member, with caulking applied for accommodating the adhesive sealing connection thereof to further panel members.

FIGS. 5–9 schematically depict the steps of assembling a plurality of roof panel members 2 adjacent one another on the roof. FIG. 5 illustrates a corner of a panel member 2A with caulking 21 applied along a recessed edge portion 19, as well as along a longitudinally extending recessed edge portion 22 corresponding, for example, to the part shown at 13 in FIG. 2. For purposes of illustration and comparison, this first panel member 2 will be designated panel member 2A.

Figure 6:
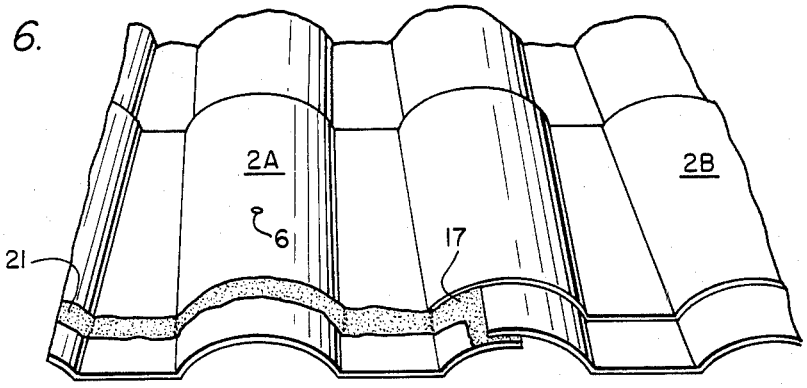
FIG. 6 is a view similar to FIG. 5, schematically depicted the attachment of a second panel member to the first panel member.
Figure 7:
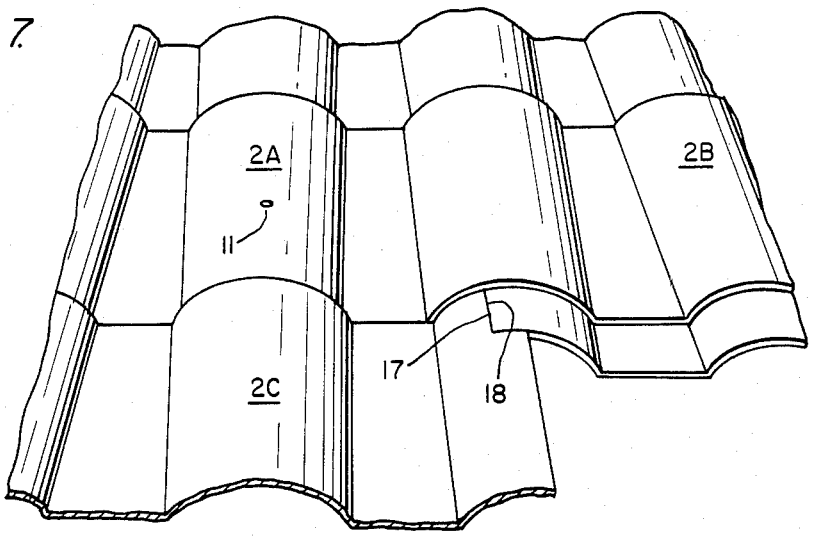
FIG. 7 is a further view similar to FIGS. 5 and 6, showing a third panel member assembled with the other two panel members.

FIG. 6 illustrates the connection of a laterally adjacent panel member 2B with a corresponding edge engageable over edge 22 and exhibiting a corner cut-out section 17. Following the attachment of panel member 2B by means of screws 6 and the adhesive caulking 21, a third panel member 2C, having a cut-out section 18 matingly engageable with cut-out section 17 of panel member 2B, is placed into a position as best shown in FIG. 7.

Figure 8:
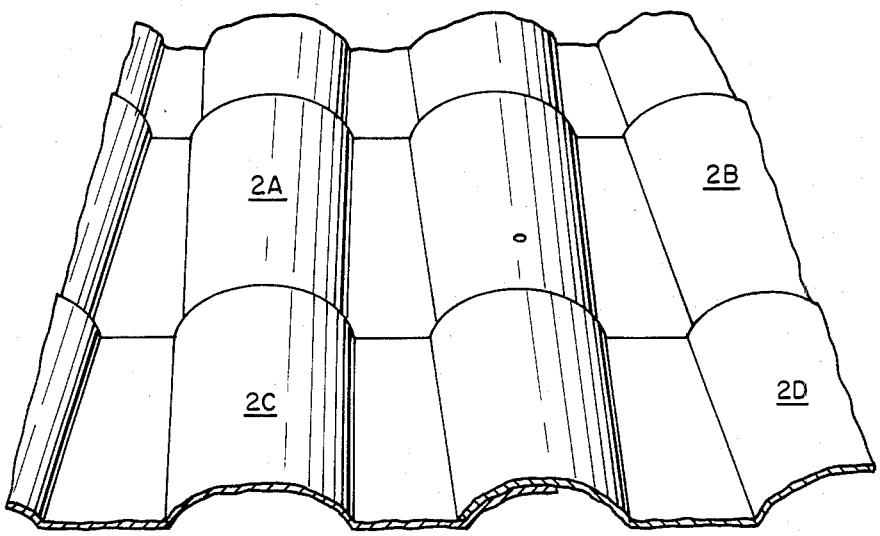
FIG. 8 is a view similar to FIGS. 5 through 7, showing the addition of a fourth panel member.

Subsequent thereto, more caulking 21 is placed over the location of the mating cut-out sections 17 and 18 and a fourth panel member 2D is placed in overlapping relationship to the panels 2A, 2B, and 2C, with the resultant end configuration as shown in FIG. 8, where the seams at the cut-out sections 18 and 19 are all covered. Via the provision of the cut-out sections 18 and 19 on the respective panel members 2, an accurate and reliable, simple to assemble, fitting-together of the roof panel members is provided. One need simply properly position the first panel member 2 on a roof rafter and firring support structure, and then repeat the steps above as setforth in this description and illustrated in FIGS. 5–8.

Figure 9:
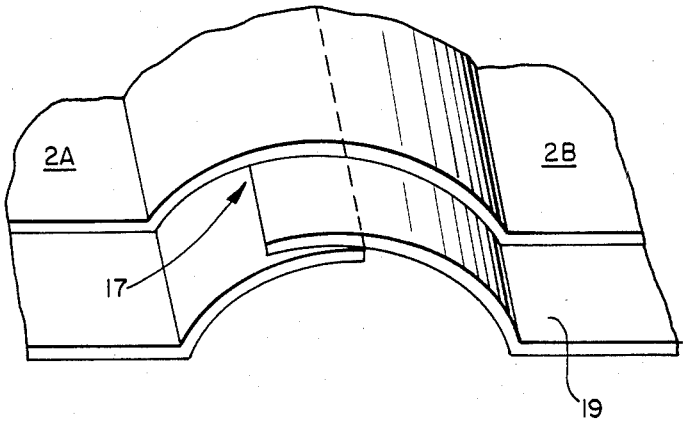
FIG. 9 is an enlarged schematic view showing the details of the corner cut-out section taken from the circled section VIII of FIG. 6.

FIG. 9 is an enlarged schematic view which depicts the details of the cut-out section 17, and its overlapping relationship to the adjacent longitudinally extending edge portion 22 of panel member 2A.

Figure 10:
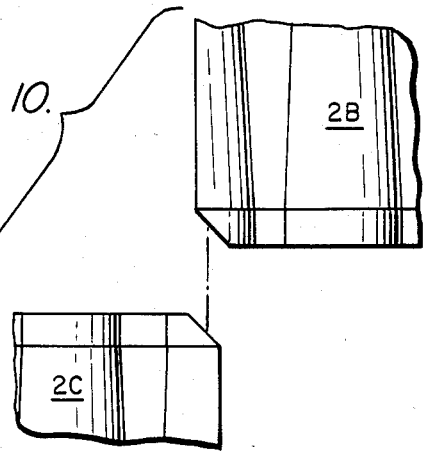
FIG. 10 is an enlarged schematic view showing an alternative embodiment of the corner cut-out sections.

FIG. 10 illustrates a modified arrangement wherein, instead of a right angle corner cut-out section such as shown in FIGS. 3–9, the diagonally opposite edges of the panel are cut at a 45° angle so as to matchingly abuttingly engage. FIG. 10 schematically depicts this configuration at adjacent panel members 2B′ and 2C′, corresponding respectively to the panels 2B and 2C of FIGS. 7 and 8.

Figure 11:
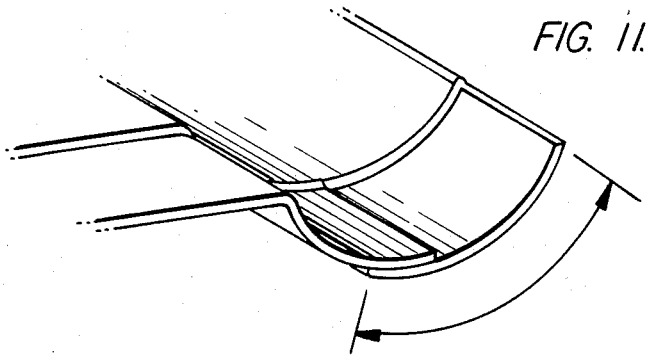
FIG. 11 is a perspective view showing an edge section of a roof panel member of the present invention and depicting the different composition at the edge as compared to the remaining panel members.

FIG. 11 is a perspective view from the bottom of an end section of a panel member 2, showing the different material for the latter part of the raised portion, designated by FRP, fiberglass reinforced plastic, with the adjacent portion FRG, being fiberglass reinforced gypsum. Thus, the remainder of the roof panel member is constructed sufficiently strong and quite economically using the fiberglass reinforced gypsum. In this way, the weight and the cost of manufacture are optimally obtained.

Figure 12:
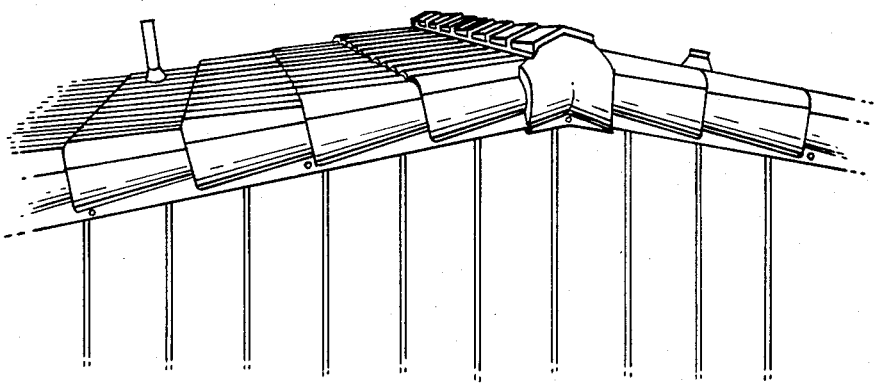
FIG. 12 is a perspective end view from above showing a section of a finished roof construction in accordance with the present invention.

FIG. 12 is a perspective end-view from above showing a portion of a completed roof assembly constructed in accordance with the present invention. In FIG. 12, it can be seen that the endcap 4 of fiberglass can be molded as one piece to cover the whole end portion. The ridge cap 3 is preferably molded in sections which overlap one another and are screwed together and sealed by polyethylene sealing compound.

The screwhead accommodating recesses 11 that are molded into the panel members are filled with a sealant plastic material during assembly. This material is preferably colored to match the gelcoat so that the finished roof has a smooth tile roof simulating appearance.

The joining edge portions 19, 21 of the panel members 2 are formed to be slightly thinner than the adjacent panel parts so that the caulking is accommodated and so that the end product has a smooth uninterrupted tile appearing surface. The panel members 2 can be of varying sizes, with practical embodiments being 32 inches wide and up to 16 feet in length. With simulated part cylindrical tiles having center lines spaced 8 inches apart and being 12 inches long, a large number of simulated tiles in each direction are included in each panel.

In preferred practical embodiments the rafters are spaced at 16 inch intervals and the firring strips are 1×3 wood purlins spaced 24 inches from one another. The tile simulations are 12 inches long in preferred practical embodiments. For this size and configuration of tile, the screws 6 are preferably No. 10, three inch long wood screws.

The roof construction of the present invention has been tested and proven to meet standards for mobile home construction.

While I have shown and described several embodiments in accordance with the present invention, it is understood that the same is not limited thereto bu is susceptible to numerous changes and modifications as would be known to those skilled in the art of the present disclosure and I therefore do not wish to be limited to the details shown and described therein but intend to cover all such changes and modifications as are encompassed by the scope of the appended claims.

I claim:

1. A simulated clay tile roof construction comprising at least one unitary roof panel member formed to simulate a plurality of clay tiles;

said roof panel member being generally rectangular and having a series of raised partial cylindrical portions joined by flat portions;

the longitudinal edges of said roof panel member being located at raised partial cylindrical portions, for overlapping or underlapping raised partial cylindrical portions of longitudinal edges of adjacent roof panel members when in an in-use position forming a roof;

edge regions located at lateral edges of said roof panel member for overlapping or underlapping by engaging corresponding edge regions of adjacent roof panel member when in an in-use position forming a roof;

diagonally opposite cut-out corner sections on raised partial cylindrical portion edge regions for abuttingly engaging corresponding cut-out sections of diagonally adjacent roof panel members when in an in-use position forming a roof; and diagonally opposite non cut-out corner sections being solid for overlapping or underlapping the abutting cut-out sections of adjacent roof panel members when in an in-use position forming a roof.

2. A construction according to claim 1 wherein said edge region at one lateral edge is recessed from the lateral edge and top surfaces of said panel member and said edge region at the other lateral edge is recessed from the lateral edge and bottom surface of said panel member.

3. A construction according to claim 1 wherein one of said longitudinal edges terminates substantially in the plane of said flat portions and the other of said longitudinal edges terminates substantially displaced from said plane of said flat portions.

4. A construction according to claim 1 wherein the longitudinal edge portions of the panel members are formed of a different structurally stronger layer of material than are the remainder of the panel portions.

5. A construction according to claim 4 wherein the majority of the last portion of the simulated tile along one longitudinal edge of the panel member is formed of fiberglass reinforced plastic and the remainder is formed with a layer of fiberglass reinforced gypsum, and wherein the weather resistant layer is a gel coating.

6. A construction according to claim 1, wherein a plurality of said roof panel members are connected together and to a roof frame structure to form a roof, wherein said roof frame structure includes rafters extending in the longitudinal direction of the simulated tile members and furring strips extending transversely to the rafters, and wherein the roof panel members are connected to the furring strips by 7 screws extending through raised portions of the simulated tile parts.

7. A construction according to claim 6, wherein roof cap means and lateral endcap means for the respective roof top and lateral ends of the simulated roof construction are provided, which roofcap means and endcap means are adhesively adhered to the panel members and exhibit an exterior weather resistant surface corresponding to the weather resistant layer of the panel members.

8. A construction according to claim 6, wherein said flat portions abuttingly engage in furring strips when said panel members are in an in-use roof construction.

9. A simulated clay tile roof construction comprising at least one unitary roof panel member formed to simulate a plurality of clay tiles, wherein said roof panel member is formed of multiple layers of synthetic materials and exhibits an upwardly facing weather resistant layer, wherein the major portion of the area of the roof panel member includes an underlayer of fiberglass reinforced gypsum, and wherein an edge portion corresponding to a substantial part of one raised simulated tile part and engageable with the next adjacent panel member is formed with an underlayer of fiberglass reinforced plastic.

* * * * *